US007323640B2

(12) United States Patent
Takahashi et al.

(10) Patent No.: US 7,323,640 B2
(45) Date of Patent: Jan. 29, 2008

(54) SHIELD CABLE, WIRING COMPONENT, AND INFORMATION APPARATUS

(75) Inventors: Hirokazu Takahashi, Tochigi (JP); Seiji Saiki, Tochigi (JP); Kiyonori Yokoi, Tochigi (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/522,577

(22) PCT Filed: Apr. 30, 2003

(86) PCT No.: PCT/JP03/05562

§ 371 (c)(1),
(2), (4) Date: Jan. 28, 2005

(87) PCT Pub. No.: WO2004/013869

PCT Pub. Date: Feb. 12, 2004

(65) Prior Publication Data

US 2006/0048966 A1 Mar. 9, 2006

(30) Foreign Application Priority Data

Jul. 31, 2002 (JP) ..... 2002-223811

(51) Int. Cl.
*H01B 7/18* (2006.01)
*H01B 9/02* (2006.01)

(52) U.S. Cl. ..... 174/106 R; 174/108

(58) Field of Classification Search ..... 174/106 R, 174/108, 36

See application file for complete search history.

(56) References Cited

U.S. PATENT DOCUMENTS

| | | | | |
|---|---|---|---|---|
| 3,163,836 | A * | 12/1964 | Masao et al. | 333/243 |
| 4,131,759 | A * | 12/1978 | Felkel | 174/107 |
| 4,552,989 | A * | 11/1985 | Sass | 174/103 |
| 5,463,188 | A * | 10/1995 | Nohmi et al. | 174/108 |
| 5,483,020 | A * | 1/1996 | Hardie et al. | 174/36 |
| 6,677,534 | B2 * | 1/2004 | Yamamoto et al. | 174/113 R |

FOREIGN PATENT DOCUMENTS

| | | |
|---|---|---|
| JP | 2000-353435 | 12/2000 |
| JP | 2001-195924 | 7/2001 |
| JP | 2003-036740 | 2/2003 |

OTHER PUBLICATIONS

Chinese Office Action issued in corresponding Chinese Patent Application No. CN 038165198, dated Aug. 11, 2006.

* cited by examiner

*Primary Examiner*—Chau N. Nguyen
(74) *Attorney, Agent, or Firm*—McDermott Will & Emery LLP

(57) ABSTRACT

A shield cable, in which a winding looseness of a shield layer due to twisting can be decreased and a short-circuit between a shield layer and signal conductor as well as a disconnection of the signal conductor is prevented, and a wiring component and information apparatus having the shield cable are provided. A twisted conductor is covered with an insulator to form an insulated wire with an outer diameter of 0.3 mm or less. This insulated wire is covered with a shield conductor and a sheath so as to form a shield cable. The shield conductor consists of a plurality of shield layers. The first shield layer at an inner most part is formed by winding conductors spirally with a scroll pitch of 7 to 13 mm. One shield cable may contain two insulated wires.

4 Claims, 7 Drawing Sheets

SHIELD CABLE, WIRING COMPONENT, AND INFORMATION APPARATUS

TECHNICAL FIELD

The present invention relates to a shield cable and a wiring component and information apparatus using the shield cable which are suitable for signal transmission in the information apparatus having a hinged portion such as a laptop personal computer, cellular phone, and video camera equipped with a liquid crystal display.

BACKGROUND ART

For signal transmission in an information apparatus such as a laptop personal computer, cellular phone, and video camera, a differential signal transmission system is often employed from a point of a measure to counter electromagnetic wave interference. A differential signal transmission system is a system to transmit a positive signal and negative signal with two signal conductors and the difference between both signals is treated as a signal value. In the differential signal transmission system, because directions of current in two signal conductors are mutually reversed, magnetic fields produced by the signals cancel out each other outside of the conductors. The smaller the distance between two signal conductors, the more effective the cancellation.

For a cable for differential signal transmission in the above-mentioned information apparatus, a two-core parallel shield cable 71 as shown in FIG. 7 is known. The shield cable 71 has two insulated wires 2 for signal transmission arranged in parallel, a first shield layer 75 and second shield layer 6 formed 5 with conducting wires integrally and spirally wound on the wires, and a sheath 8 over the shield layers. As occasion demands, a third shield layer 7 consisting of a metal tape, etc. is provided between the shielding layers 75 and 6 and the sheath 8. The shield cable 71 can be made more easily than a shield cable in which a shield layer is formed with a braided conducting wire and has an advantage in terms of cost in the case having a small diameter.

The insulated wire 2 has a structure in which a signal conductor 3 having an outer diameter of 0.09 mm and consisting of seven stranded tin plated copper alloy wires each having an outer diameter of 0.03 mm is covered with a fluoric resin insulator 4 such that the outer diameter of the insulated wire 2 is 0.21±0.03 mm. The shield layer 75 is formed by spirally winding, at a pitch of 5 to 7 mm, about 33 to 43 tin plated copper alloy conducting wires, which are the same wires as those used for the signal conductor 3, each having an outer diameter of 0.03 mm.

In a case of a cable having only the shield layer 75, when it is bent or twisted, a gap may arise between the conducting wires, resulting in shortage of shielding effect, and therefore the shield layer 6 is formed on the shield layer 75 so that the shielding effect can be assured. The shield layer 6 is formed by spirally winding, at a pitch of 5 to 7 mm, 38-48 conducting wires, which are the same wires as those used for the shield layer 75. Usually the shield layer 6 is formed by winding the conducting wires in an opposite winding direction relative to the winding direction of the shield layer 75. The sheath 8 is formed with a polyester tape wound on the shield layer.

With one or more shield cables 71 having an above-described structure, a wiring between a main body portion and a liquid crystal display is provided in an information apparatus. In this case, one or more shield cables 71 are wired through a connection portion having a hinging mechanism for opening and closing the display.

Repeated opening and closing of the display causes a conducting wire of the shield layer 75 to break and the broken wire to stick to the insulator 4 of insulated wire 2 so that the broken wire and the signal conductor 3 short-circuit. In addition, in case a plurality of shield cables 71 are bundled, repeated opening and closing of the display causes the signal conductor 3 to disconnect.

DISCLOSURE OF THE INVENTION

The object of the present invention is to provide a shield cable in which a disconnection of the signal conductor as well as a short-circuit between a shield layer and signal conductor is prevented, and to provide a wiring component and information apparatus having the shield cable.

In order to achieve the object, provided is a shield cable which is structured such that one or more insulated wires having signal conductors are covered with a shield conductor consisting of a plurality of shield layers and further covered with a sheath. A first shield layer that constitute the innermost layer of the plurality of shield layers consists of a plurality of conductors spirally wound at a pitch of 7 mm to 13 mm. The insulated wires may be two insulated wires whose diameters are not more than 0.3 mm, and the plurality of shield layers and the sheath may integrally cover the insulated wires.

Another aspect of the present invention provides a wiring component in which a plurality of shield cables according to the present invention are bundled and a connecting terminal portion is provided at least at one end of the wiring component. Yet another aspect of the present invention provides an information apparatus in which a shield cable according to the present invention is used for signal wiring to pass through a hinged portion of the information apparatus.

The present invention is further explained below by referring to the accompanying drawings. The drawings are provided solely for the purpose of illustration and are not intended to limit the scope of the invention.

BRIEF DESCRIPTION OF THE DRAWINGS

FIG. 1A is a cross-sectional view and FIG. 1B is a side view of the cable whose circumference is partially removed.

FIGS. 3A and 3C are side views and FIGS. 3B and 3D are sectional views.

BEST MODES FOR CARRYING OUT THE INVENTION

Figure 1A:
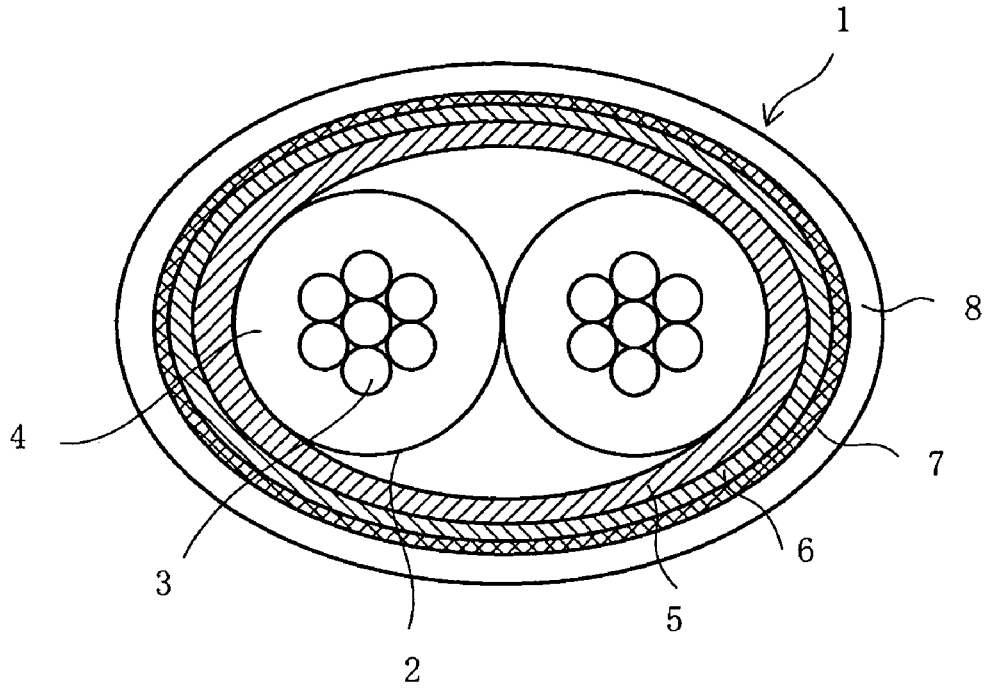
FIGS. 1A and 1B are views explaining an embodiment of a shield cable according to the present invention.

Embodiments of the present invention are explained below by referring to the accompanying drawings. In the drawings, the same number refers to the same part to avoid duplicate explanation. The ratios of the dimensions in the drawings do not necessarily coincide with the explanation.

Figure 1B:
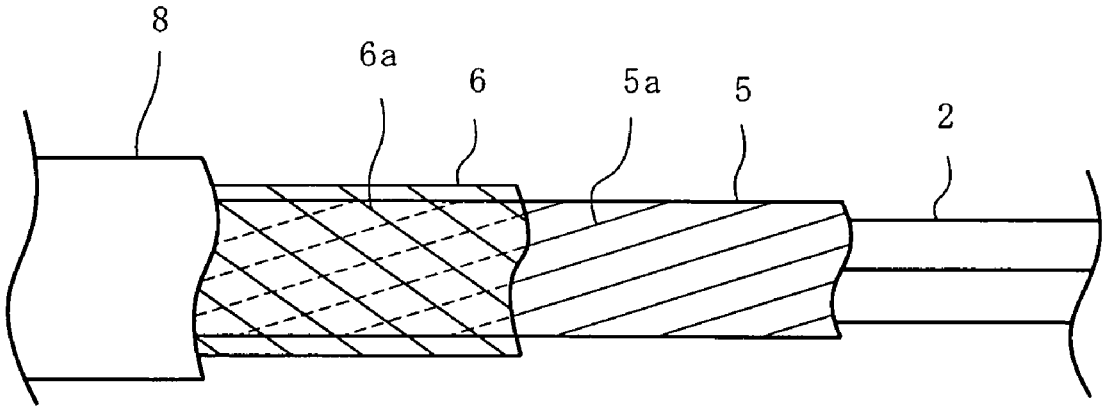

Referring to FIGS. 1A and 1B, an embodiment of a shield cable according to the present invention is explained. A two-core parallel shield cable 1 has two insulated wires 2 for signal transmission arranged in parallel and a shield conductor integrally covering the outside of the two insulated wires 2. The shield conductor consists of a plurality of shield layers, having at least a first shield layer 5 and a second shield layer 6, which consist of a plurality of conducting wires 5*a* and 6*a*, spirally wound respectively. In addition, as occasion demands, a third shield layer 7 consisting of a metal tape, etc. is provided. A sheath 8 is provided on the outermost surface of the shield conductor so as to protect the shield layer and the cable portion inside thereof.

The insulated wire 2 has, for example, a structure in which a signal conductor 3 having a diameter of about 0.09 mm and consisting of seven stranded tin plated copper alloy wires each having a diameter of 0.03 mm is covered with an insulator 4 such as fluoric resin or polyethylene such that the outer diameter becomes 0.3 mm or less. The first shield layer 5 consists of about 33 to 43 conducting wires 5*a*, which are, for example, the same as those used for the signal conductor 3 and which are wound spirally rightwards (left-hand lay). Here, a conducting wire of a shield layer can be wound in right hand lay or left hand lay, and one winding direction is called a counter winding direction relative to the other winding direction.

On the shield layer 5, the second shield layer 6 is formed to prevent the generation of a gap between the conducting wires when the cable is bent or twisted, which gap causes a shortage of shielding effect. The shield layer 6 consists of 38 to 46 conducting wires 6*a* which are the same as those used for the shield layer 5 and which are spirally wound in the opposite direction relative to the shield layer 5. The number of conducting wires 6*a* is increased to some extent, because the diameter of the shield layer 6 is greater than the diameter of the shield layer 5. By winding a second shield layer in the opposite direction to the shield layer 5, disordering of the shield layer 5 can be prevented and the occurrence of a gap or a curl due to a bending of the cable can be reduced. The number of the conducting wires 5*a* and 6*a* can be increased or decreased depending on the outer diameter of the insulated wire 2.

The third shield layer consists of a wound metal foil tape, for example, aluminum-polyethylene terephthalate (PET) tape or copper-evaporated PET tape. The third shield layer completely surrounds the circumference of the insulated wires 2 without a gap so that shielding can completely be achieved. On the shield conductor, a polyester tape is wound to form a sheath 8 to protect the shield conductor and secure mechanical strength of the two-core parallel shield cable.

Figure 1C:
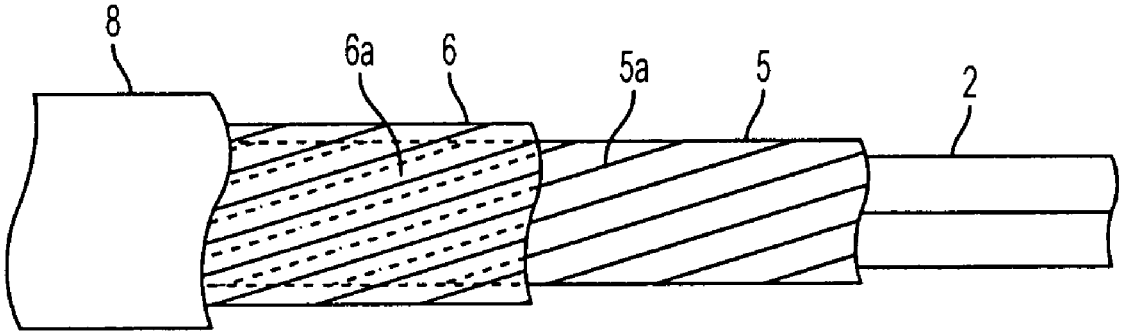
FIG. 1C is a side view, similar to FIG. 1B, of another embodiment.

The embodiment shown in FIG. 1C differs from the embodiment illustrated in FIG. 1B, described above, in that first shield layer 5 and second shield layer 6 are spirally wound in the same direction.

Figure 2A:
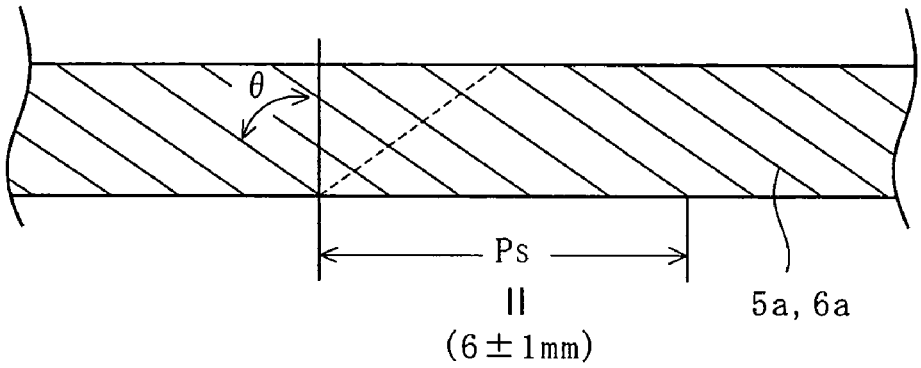
FIGS. 2A and 2B are views explaining a scroll pitch of a shield layer.
Figure 2B:
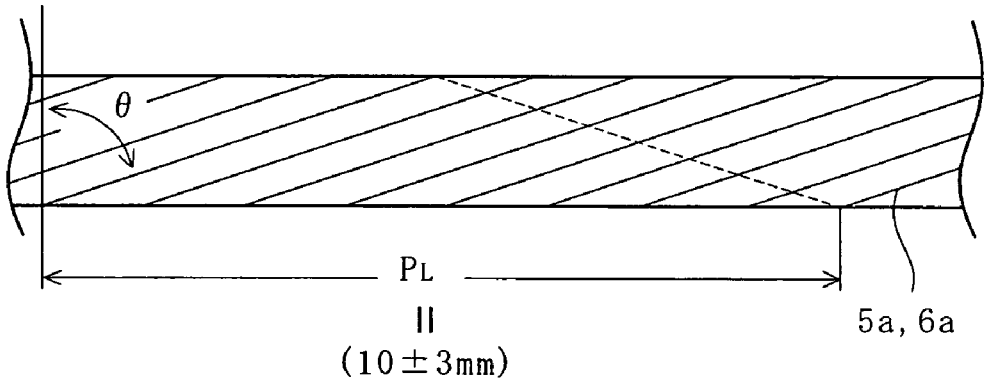

FIGS. 2A and 2B are views explaining a scroll pitch of the shield layers 5 and 6. The scroll pitch is defined as a longitudinal distance where the conducting wires 5*a* or 6*a* forming a shield layer are wound one turn over the insulated wires 2. FIG. 2A shows an example of a right hand lay having a scroll pitch $P_S$=6±1 mm. FIG. 2B shows an example of a left hand lay having a scroll pitch $P_L$=10±3 mm.

Figure 3A:
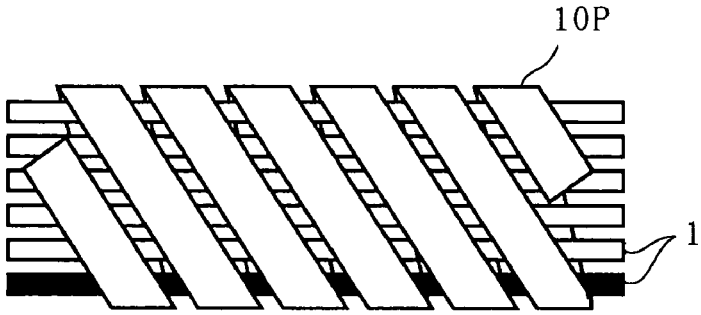
FIGS. 3A to 3D are views explaining a situation of a tension induced by a twist of a shield cable.
Figure 3B:
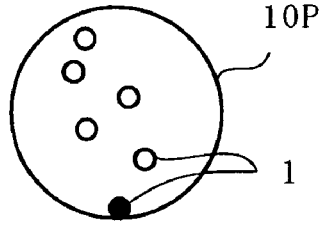
Figure 3C:
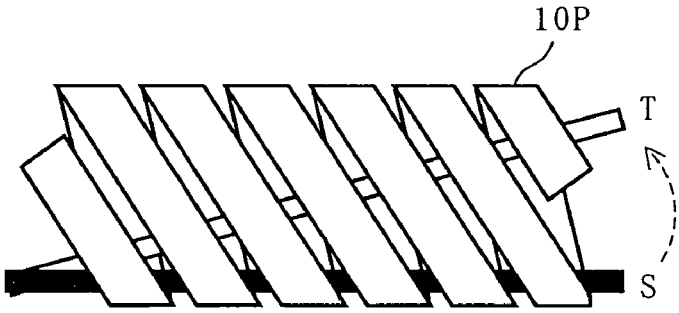
Figure 3D:
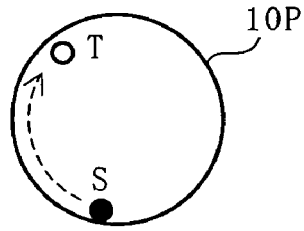

The inventors clarified, as described in the following, the relation between the outbreak of disconnection or short-circuit and the scroll pitch of the first shield layer and the second shield layer which constitute the shield conductor. When the shield layers are formed with a small scroll pitch, because winding angles θ of the conducting wires 5*a* and 6*a* are small, a wound form can be stable and the shielding effect can be increased. However, as shown in FIGS. 3A and 3B, when a plurality of shield cables 1 bundled with a cable tie 10, etc. are twisted in an apparatus, a shield cable 1, for example, in the S position moves to the T position such that tensile force occurs. In this case, if the winding angle θ of the first shield layer 5 is small, tensile force concentrates on the internal signal conductor 3 and accordingly disconnection is easily caused because of high expansion and contraction properties along the longitudinal direction of the shield layer 5.

In addition, if the shield cable 1 is twisted in a manner in which the winding of the shield layer 5 becomes loose, the winding of the shield layer 6 becomes tight. In this situation, if the shield layer 5, which is loose, is bound tightly with the shield layer 6, the shield layer 5 is damaged and broken. If the shield cable 1 having the broken shield layer 5 is twisted repeatedly, a broken conducting wire sticks to the insulator 4 of the insulated wire 2 facilitating a short-circuit to occur between the signal conductor 3 and the shield layer.

When the shield layer is formed with a large scroll pitch, winding angles θ of the conducting wires 5*a* and 6*a* are large. In such case, when the shield cable 1 is bent, the conducting wires 5*a* and 6*a* are apt to fall into disorder and shielding effect is reduced. In such case, however, because the expansion and contraction properties along the longitudinal direction decrease, some part of the tensile force applied to the signal conductor 3 can be shared with the shield layer 5 when tensile force is added to the shield cable 1, and accordingly disconnection of signal conductor 3 can be reduced. In addition, when the shield cable 1 is twisted in a direction such that the winding of the conducting wires 5*a* becomes loose, the degree of looseness is relatively small, and accordingly disconnection of conducting wire 5*a* is reduced and short-circuit seldom occurs despite the first shield layer being tightly bound by the second shield layer 6.

According to the present invention, as shown in FIG. 1B, at least the first shield layer 5 located at an inner side is formed with a pitch of 7-13 mm. The second shield layer 6 is formed with a pitch equal to or less than the pitch of the shield layer 5. The winding directions of the conducting wires in the shield layer 5 and the shield layer 6 may be the same or different from each other.

In a conventional shield cable, the difference in pitches of a first shield layer 5 and second shield layer 6 is usually small or about 6±1 mm at most, and accordingly short-circuit by breakage of the shield layer 5 and a disconnection of a signal conductor 3 are apt to occur. In the present invention, at least by forming the first shield layer located at an inner side with a pitch of 7-13 mm, disconnection of signal conductor 3 and short-circuit outbreak between the shield layer 5 and the signal conductor 3 can be reduced.

Though the winding is unstable to some extent by setting the scroll pitch of the first shield layer to 7-13 mm compared to the case in which the pitch is set to 5-7 mm, there is no problem substantially, because the disordering of the shielding layer 5 can be prevented by winding the second shield layer in the opposite direction to the first shield layer. Even if the second shield layer 6 is wound up in the same direction, a disordering of the shield layer 5 can be suppressed by winding the shield layer 6 at a pitch not exceeding the pitch of the shield layer 5. Furthermore, the third shield layer 7 consisting of a metal leaf can be arranged. In this case, because a shielding effect is further achieved, the shield effect is not reduced despite the shield layer 5 being formed with a pitch of 7-13 mm. If the pitch is not less than 13 mm, the winding becomes unstable, causing difficulty in the production.

Figure 4:
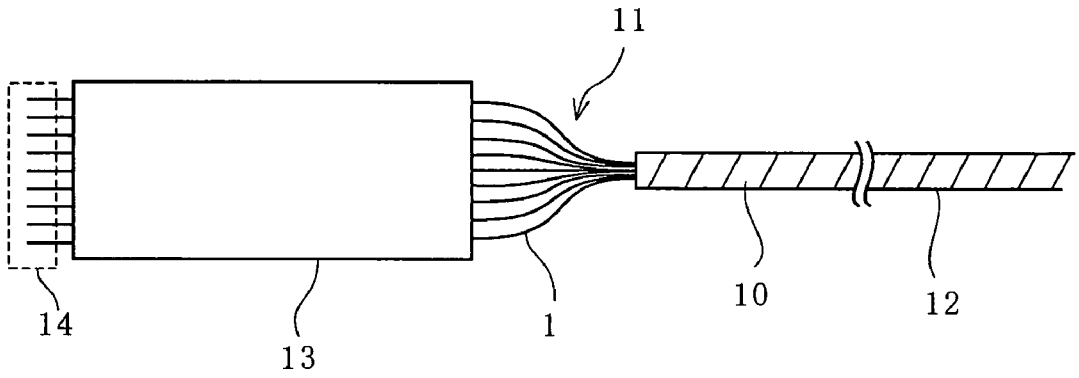
FIG. 4 is a view showing an embodiment of a wiring component according to the present invention.

FIG. 4 is a view showing an embodiment of a wiring component according to the present invention. A wiring component 11 has a pre-formed dimension and shape that can facilitate wiring and is equipped with a plurality of parallel two-core shield cables 1 according to the present invention, and at least one end thereof is provided with a connecting terminal portion 14 (in which the cables 1 are arranged at a predetermined pitch on a plane and in some cases the insulation coating thereof is removed at a predetermined length) for connection with connecting terminals in the information apparatus. A wiring component may has a structure in which a shield cable 1 and another cable, for example, a coaxial signal cable are used in combination.

In the wiring component 11, a plurality of parallel two-core shield cables 1 may have a bunched cable portion 12 lapped with a cable tie 10, for example, and may also have an tape-shape arrayed portion 13 in which a plurality of parallel two-core shield cables 1 are arranged in a line to be a tape-shape as needed, adjacent to the connecting terminal portion 14. The connecting terminal portion 14 may include an electrical connector or be processed (for example, by processing of a shield conductor and processing of ground connection) so as to have a terminal shape that can allow easy connection to an electric connector or a connection terminal.

Figure 6:
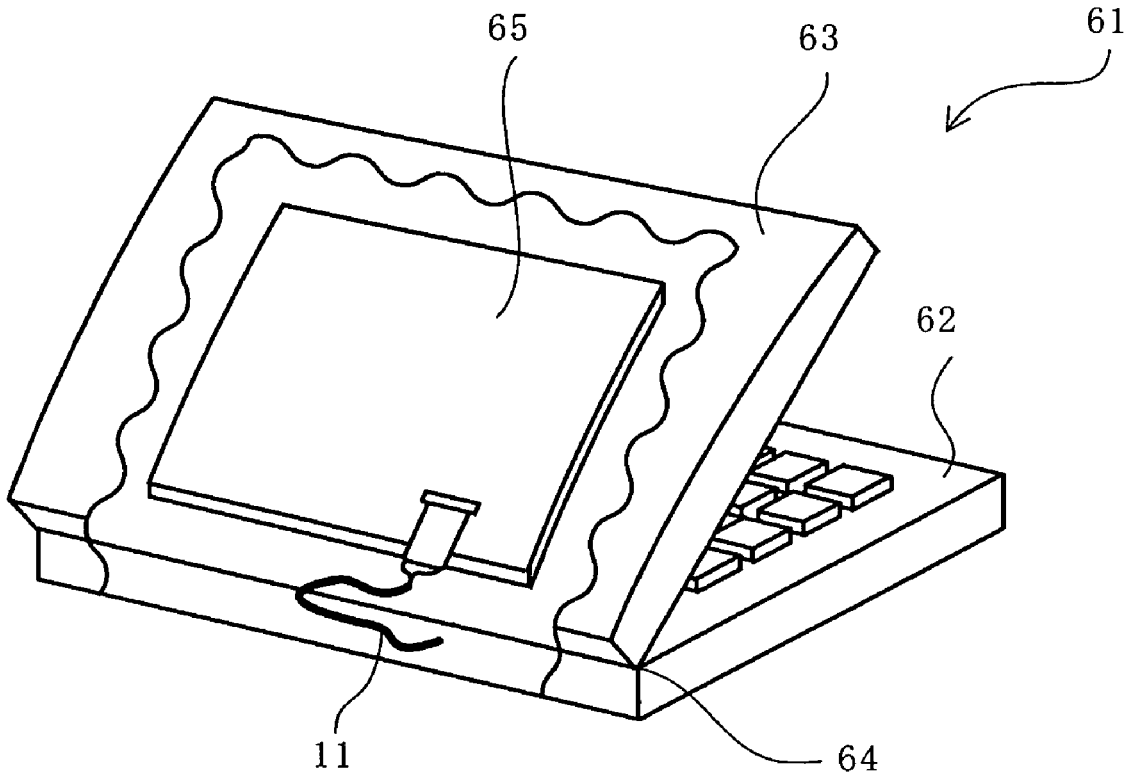
FIG. 6 is a view explaining an embodiment of an information apparatus according to the present invention.
Figure 7:
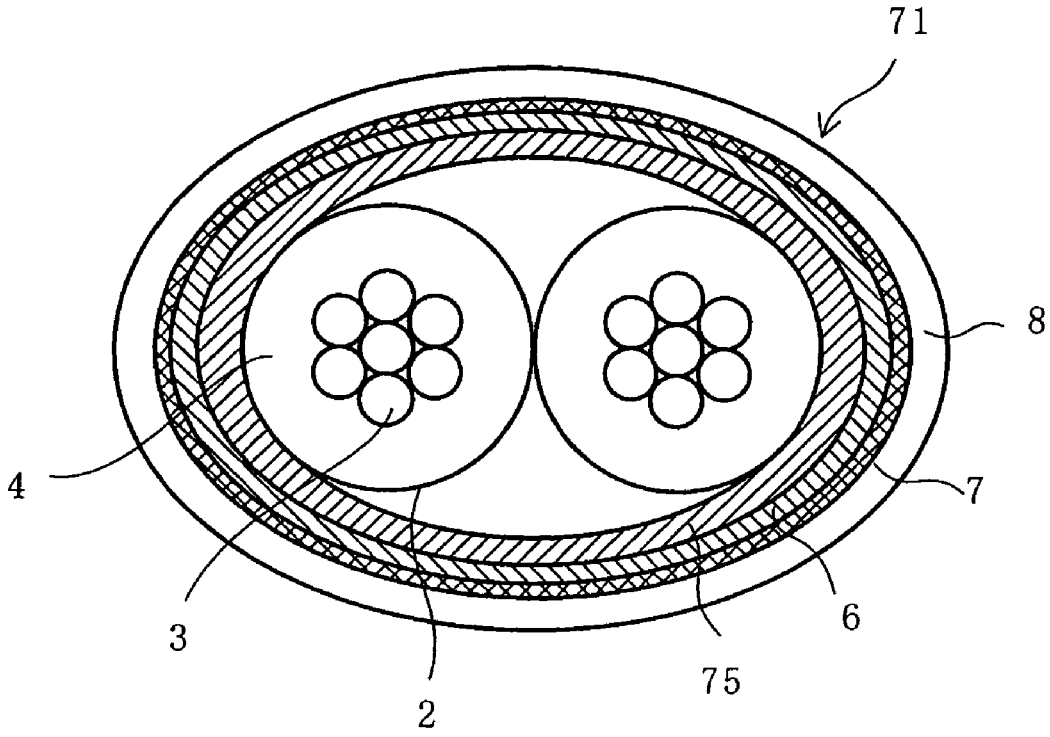
FIG. 7 (PRIOR ART)
FIG. 7 is a view explaining a conventional two-core parallel shield cable.

FIG. 6 is a view explaining an embodiment of an information apparatus according to the preset invention. A laptop personal computer 61 consists of a main body portion 62 and a display 63 and both are connected with a hinge 64. In the main body portion 62, there includes a main board, which is not illustrated, and the display 63 includes a liquid crystal panel 65. The main board and the liquid crystal panel 65 are connected by wiring component 11 that extends through a hinged portion 64.

EXAMPLE

Figure 5A:
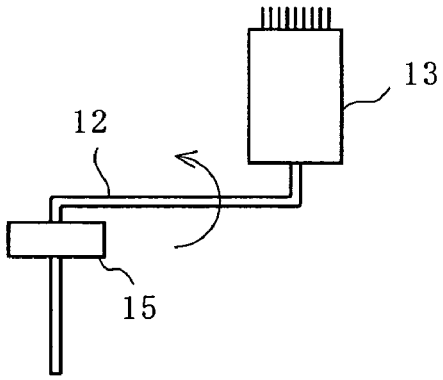
FIGS. 5A and 5B are views explaining an evaluation method of a shield cable.
Figure 5B:
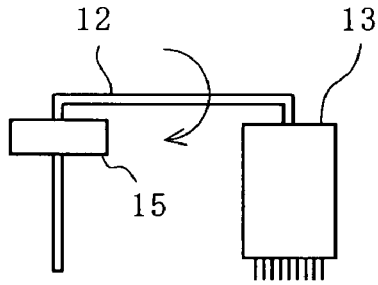

To confirm an effect of the present invention, an evaluation was proceeded by a method as shown in FIGS. 5A and 5B. As a sample for evaluation, a wiring component 11 shown in FIG. 4 having nine shield cables 1 is used. The bunched cable portion 12 of the wiring component 11 was bent as shown in FIG. 5A and one end side thereof was fixed with a clamp 15, and the other end side adjacent to the tape-shape arrayed portion 13 was twisted at 180 degrees so that a 180 degree-twist is caused in a predetermined length in the bunched cable portion 12. In the evaluation, the number of twistings before either one of the signal conductors (2×9 wires) of an insulated wires is broken and the number of twistings before the first shield layer and a signal conductor make a short-circuit were measured. Here, the number of twistings was determined under the definition that one twist means one cycle of twisting from zero degree to 180 degrees and 180 degrees to 0 degree.

A two-core parallel shield cable used for such evaluation had two insulated wires, each consisting of signal conductors of 0.09 mm in outer diameter, each of which was made of seven stranded tin-plated copper alloy wires of 0.03 mm in outer diameter, and each of the insulated wires was made by covering the signal conductor with a fluoric resin such that the outer diameter of the insulated wire had a diameter of 0.21±0.03 mm. The first shield layer was formed by winding 38 tin-plated copper alloy wires each having an outer diameter of 0.03 mm, and the second shield layer was formed with 43 wires of the same kind as the first shield layer. The first and second shield layers were formed with four different conditions in terms of winding direction and scroll pitch as shown in Table I. The third shield layer was formed by lapping a copper-evaporated polyester tape in a right-hand lay and the sheath was formed by lapping a polyester tape in a right-hand lay.

Using the shield cables the number of twistings before either one of the signal conductors is broken and the number of twistings before the first shield layer and the signal conductor make a short-circuit were measured with a method shown in FIGS. 5A and 5B. Results are shown in Table I.

TABLE I

| | | Example 1 | Example 2 | Example 3 | Comparative example |
|---|---|---|---|---|---|
| Winding direction and scroll pitch | First shield layer | Right 10.0 mm | Right 10.0 mm | Right 10.0 mm | Right 6.0 mm |
| | Second shield layer | Left 6.0 mm | Left 10.0 mm | Right 10.0 mm | Left 6.0 mm |
| Number of twistings before a signal conductor is broken | | 46,151 | 44,697 | 45,099 | 20,908 |
| Number of twistings before a short circuit occurs | | 11,098 | 12,051 | 13,094 | 1,325 |

From the results, it was found that the number of twisting before either one of the signal conductors is broken can be made not less than two times of that in the comparative example by setting the scroll pitch of the innermost first shield layer to greater than that in the comparative example. It was also found that the number of twistings before a short circuit occurs between a first shield layer and a signal conductor can be made not less than eight times of that in the comparative example. In addition, it was found that alteration in terms of a scroll pitch of the second shield layer and a twisting direction hardly affects the disconnection and short-circuit outbreak.

The entire disclosure of Japanese Patent Application No. 2002-223811 filed on Jul. 31, 2002 including specification, claims, drawings, and summary are incorporated herein by reference in its entirety.

INDUSTRIAL APPLICABILITY

A shield cable according to the present invention is preferably used for wiring that is laid through a hinged portion in an information apparatus having the hinged portion for opening and closing mechanism of a liquid crystal display. In particular, recently, the reliability and life of a main body portion and a liquid crystal display of an information apparatus has increased, with their performance failure being decreased. Therefore, a performance failure due to disconnection in a cable or a short-circuit caused by twisting in a hinged portion is annoying for the user. Thus, reliability of an information apparatus having a hinged portion can be further increased by using a shield cable of the present invention. It is also possible to achieve the same goal by using a wiring component such as shown in FIG. 4.

The invention claimed is:

1. A shield cable comprising:

two insulated wires, having diameters not more than 0.3 mm, and covered with a shield conductor and a sheath, each of said insulated wires comprising a signal conductor covered with an insulator, said shield conductor consisting of a plurality of shield layers, wherein a first shield layer constituting the innermost layer of said plurality of shield layers consists of a plurality of conductors spirally wound at a pitch of 10 to 13 mm;

a second shield layer is formed by spirally winding a plurality of conductors on said first shield layer in a counter winding direction relative to that of said first shield layer; a scroll pitch of said second shield layer is not more than a scroll pitch of said first shield layer; and said sheath and said plurality of shield layers integrally cover said insulated wires.

2. A wiring component in which a plurality of shield cables according to claim 1 are bundled and a connecting terminal portion is provided at least at one end of said wiring component.

3. An information apparatus having a shield cable according to claim 1, said shield cable being used for a signal wiring to pass through a hinged portion of said information apparatus.

4. An information apparatus having a wiring component according to claim 2, said wiring component being used for a signal wiring to pass through a hinged portion of said information apparatus.

* * * * *